United States Patent [19]

Griffith

[11] Patent Number: 4,678,881

[45] Date of Patent: Jul. 7, 1987

[54] INDUCTION APPARATUS FOR HEATING AND MIXING A FLUID

[75] Inventor: John T. Griffith, Mold, United Kingdom

[73] Assignee: The Electricity Council, London, England

[21] Appl. No.: 867,994

[22] Filed: May 28, 1986

[30] Foreign Application Priority Data

May 28, 1985 [GB] United Kingdom ..... 8513505

[51] Int. Cl.[4] ..... H05B 6/10

[52] U.S. Cl. ..... 219/10.51; 219/10.65; 219/10.79; 366/146; 366/251

[58] Field of Search ..... 219/10.51, 10.49 R, 219/10.65, 10.43, 10.79; 366/144, 146, 249, 251

[56] References Cited

U.S. PATENT DOCUMENTS

| | | | |
|---|---|---|---|
| 2,549,362 | 4/1951 | Bessiere et al. | 219/10.51 |
| 3,127,155 | 3/1964 | Geffcken | 219/10.65 X |
| 3,936,625 | 2/1976 | Burnett | 219/10.51 |
| 4,090,054 | 5/1978 | Heine et al. | 219/10.49 R |
| 4,238,337 | 12/1980 | Peters et al. | 219/10.49 R X |
| 4,484,049 | 11/1984 | Ahner et al. | 219/10.51 |

*Primary Examiner*—Philip H. Leung

*Attorney, Agent, or Firm*—Beveridge, DeGrandi & Weilacher

[57] ABSTRACT

The simultaneous heating and mixing of a fluid in a vessel with heated walls and a stirring device can lead to excessively high temperatures at the walls due to the formation of a thick boundary layer. This specification discloses a stirring paddle incorporating a heated element and mounted on a rotatable shaft. The heating element is connected in series with a rotor winding mounted on the shaft so that, when the shaft rotates, a heating current flows through the heating element.

7 Claims, 1 Drawing Figure

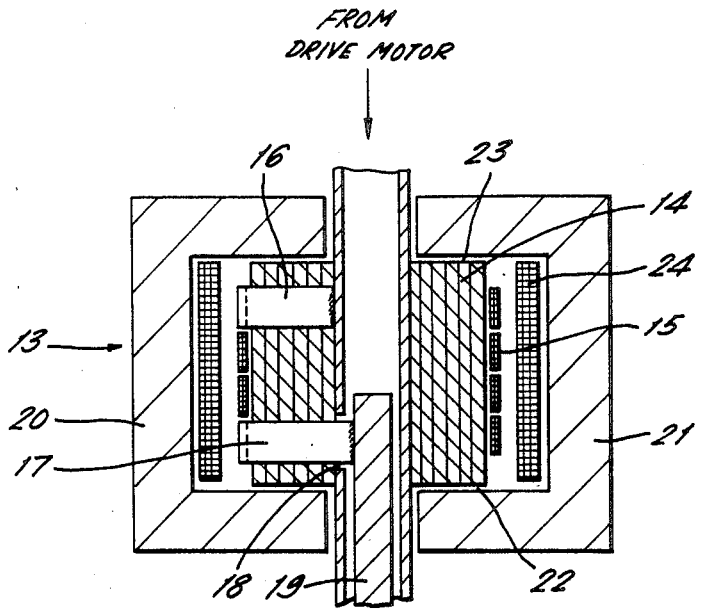
FROM
DRIVE MOTOR
16
23
14
24
15
13
20
21
17
18
19
22
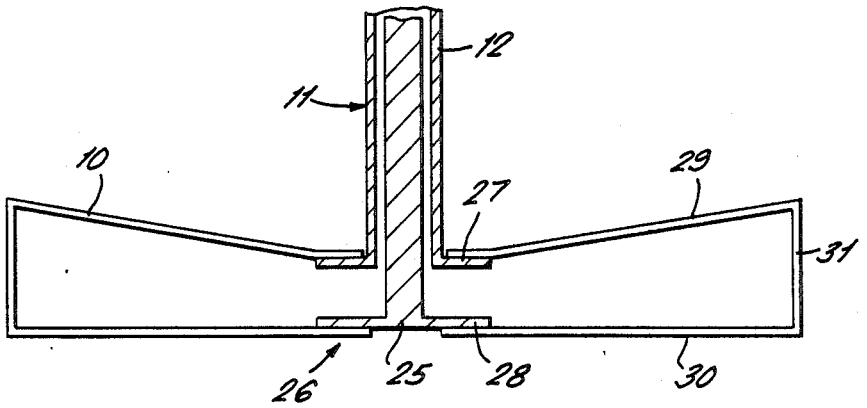
12
11
10
29
27
31
26
25
28
30

INDUCTION APPARATUS FOR HEATING AND MIXING A FLUID

BACKGROUND OF THE INVENTION

The present invention is concerned with apparatus for simultaneously heating and mixing a fluid.

It is frequently desirable to mix and blend viscous liquids and simultaneously to raise their temperature. This is commonly done in a vessel with heated walls and the product is stirred with a propellor type paddle.

In prior art arrangements, problems can arise due to the thick boundary layer of the fluid at the vessel wall which restricts heat transfer into the bulk of the fluid and may result in excessive local temperatures if attempts are made to heat the product quickly.

BRIEF SUMMARY OF THE INVENTION

According to the present invention, apparatus for heating and mixing a fluid comprises a vessel for fluid to be heated and mixed, a mixing paddle in the vessel and rotatable on a shaft to mix the fluid, a magnetic rotor core mounted on the shaft to rotate with the shaft, an electric conductor circuit formed of a rotor winding on the rotor core in series with a heating conductor in the paddle, and induction means to generate, at least on rotation of the shaft, a varying magnetic flux in the rotor core to induce a heating current in said rotor winding and the heating conductor in the paddle. With this arrangement, the paddle itself is heated in order to heat the fluid being mixed. Because the paddle is continuously moving in the fluid there is only a very thin boundary layer at the surface of the paddle, so that a heated paddle can greatly increase the speed at which heat can be put into the fluid without local overheating.

The heating current to the heating conductor in the paddle is supplied by means of the induction coupling between the magnetic rotor which rotates with the shaft of the paddle and the induction means. This avoids the need for any slip rings and brushes to connect the current supply to the rotating shaft.

Normally, the paddle and the rotor core are axially spaced along the shaft and the shaft then includes concentric conductor elements interconnecting the rotor winding and the heating conductor in the paddle. The paddle may be formed of at least one blade extending from a hub supported by the shaft and said heating conductor then comprises a metal element forming part of or embedded in the blade and connected at the hub between said concentric conductor elements.

In one embodiment, the induction means comprises a fixed stator core arranged to complete a magnetic circuit with the rotor core with air gaps between the stator and rotor cores, and a stator winding on the stator core to generate said varying magnetic flux in the cores, said stator and rotor windings constituting the primary and secondary windings respectively of a transformer.

In another embodiment, said induction means comprises the stator core and winding of an induction motor and the rotor core and rotor winding constitute the rotor of the motor, whereby said motor is operative simultaneously to rotate the shaft and to induce said heating current.

In yet a further embodiment, said induction means comprises the stator of an electric generator arranged to generate a current in the rotor winding on rotation of the shaft.

BRIEF DESCRIPTION OF THE DRAWINGS

Examples of the invention will now be described with reference to the accompanyimg drawings in which FIG. 1 is a cross sectional view of a heated paddle and a rotary transformer for simultaneously heating and mixing viscous liquid and in which FIG. 2 is a cross sectional view of a heated paddle and an induction motor for simultaneously heating and mixing a viscous liquid.

DETAILED DESCRIPTION

Referring to FIG. 1, a paddle 10 is shown mounted at one end of a rotary shaft 11. The shaft 11 and paddle 10 may be rotated by means of a drive motor which is not shown in the drawing. Furthermore, it will be appreciated that the paddle is intended for mixing together fluid materials, typically viscous liquid materials, which will be contained in a vessel 9.

The shaft 11 comprises a hollow tube 12 of highly conductive metal. The shaft extends between the drive motor and the paddle through a rotary transformer indicated generally at 13. The transformer 13 comprises a rotor core element 14 which is rigidly fixed to the tube 12 of the shaft so as to rotate with the shaft. The rotor 14 is symmetrical about the shaft axis. A rotor winding 15 is provided around the rotor core 14, forming a helix which is coaxial with the axis of the shaft 11. One end 16 of the rotor winding 15 is electrically bonded, e.g. by welding, to the tube 12 of the shaft 11. The other end 17 of the core winding passes through an aperture 18 in the tube 12 and is electrically bonded, e.g. by welding, to an inner coaxial electrically conducting element 19. The conductor 19 comprises a metal rod which is mounted coaxially inside the tube 12 and arranged to be electrically insulated from the tube 12 along its length. The means of insulation and support for the rod 19 are not shown in the drawing but may take the form of example of a sleeve of insulating material.

Stator core sections 20 and 21 are provided on opposite sides of the shaft 11. The core sections 20 and 21 are fixed so that the shaft 11, the rotor core 14 and rotor winding 15 all rotate relative to the stator core sections 20 and 21. Each stator core section comprises a U shaped element on its side with narrow air gaps 22, 23 formed between the arms of the U and annular faces of the rotor core 14. Thus, the rotor core 14 effectively provides two complete magnetic circuits between the arms of the respective core sections 20 and 21. A primary winding 24 is provided mounted inside the core sections 20 and 21, surrounding the rotor core 14 and rotor winding 15 and with its winding axis substantially coaxial with the axis of the shaft 11.

It can be seen that the resultant structure is comparable to a double D transformer structure with primary and secondary windings wound on the central upright of a double D transformer core. However in the present case, the central upright of the core is constituted by the rotor core 14 which rotates with the shaft 11.

It can be seen accordingly that an alternating current in the primary winding 24 produces an alternating magnetic flux in the core sections 20 and 21 and also the rotor core 14 which interlinks the secondary winding 15 to produce a secondary current. In some circumstances the stator core sections 20 and 21 may be omitted and the flux permitted to return in the air.

The secondary circuit is completed between the outer tube 12 of the shaft and an end 25 of the inner rod 19 where it extends from the end of the tube 12 at a hub 26 carrying the paddle 10.

The detailed construction of the paddle 10 is not critical. In one example, the paddle is formed of an electrically conductive material formed as a "bow-tie" having an upper layer 29 electrically connected at 27 to the outer tube 12 of the shaft, and a lower layer 30 electrically connected at 28 to the inner rod 19. The outer ends of the blades of the paddle are interconnected by webs 31, so that current flows between the tube 12 and rod 19 to the outer edge of each blade and back again. The blades are hollow as shown in the drawings to permit fluid to be heated to pass between the layers 29 and 30 as the paddle is rotated. The blades may be somewhat twisted out of the plane perpendicular to the shaft axis to provide a propeller effect.

In another example the paddle is made of an insulating material and has conductive elements embedded in it to carry the heating current.

For maximum efficiency, the air gaps 22 and 23 should be as narrow as possible. It is important that the shaft and rotor 14 is mounted so as to prevent any axial movement of the shaft relative to the stator core sections 20 and 21. Desirably the shaft and rotor core 14 is mounted relative to the stator core sections 20 and 21 so that the attractive forces between the core sections across the air gaps 22 and 23 are equal and opposite.

The heretofore described example of this invention using a "rotary" transformer requires a separate drive motor to drive the shaft to rotate the paddle for mixing and stirring the material to be heated. The rotary transformer 13 does not itself contribute any significant torque to the shaft.

However instead of the described rotary transformer, in FIG. 2 a heating current is developed to heat the paddle by connecting the paddle heating circuit in series with the rotor winding of an induction motor provided with a suitable stator winding. The paddle heating elements then constitute part of the rotor resistance of the motor and the induction motor provides both the rotary drive to the shaft 11 and also the heating element current. Like numerals reference like integers in both FIGS. 1 and 2.

In another example, the shaft 11 is driven from a separate motor and the heating element circuit is derived from a passive generator instead of the rotary transformer illustrated. The passive generator consumes no additional electric power but the rotor winding current is generated by rotation of the shaft in a magnetic field produced by a suitable stator arrangement. It will be appreciated that generating the heating current requires substantial additional torque to be applied to the shaft 11 by means of the drive motor.

Although the above examples have been described in their application to the mixing and heating of fluids, particularly viscous liquids, the principles of the invention are equally applicable to the heating of particulate and powder materials and the word "fluids" used herein should be construed as covering also these particulate or powdery substances.

I claim:

1. Apparatus for heating and mixing a fluid, comprising a vessel for fluid to be heated and mixed, a mixing paddle in the vessel and rotatable on a shaft to mix the fluid, a magnetic rotor core mounted on the shaft to rotate with the shaft, an electric conductor circuit formed of a rotor winding on the rotor core in series with a heating conductor in the paddle, and induction means to generate, at least on rotation of the shaft, a varying magnetic flux in the rotor core to induce a heating current in said rotor winding and the heating conductor in the paddle.

2. Apparatus as claimed in claim 1 wherein the paddle and the rotor core are axially spaced along the shaft, and the shaft includes concentric conductor elements interconnecting the rotor winding and the heating conductor in the paddle.

3. Apparatus as claimed in claim 2 wherein the paddle is formed of at least one blade extending from a hub supported by the shaft and said heating conductor comprises a metal element forming part of or embedded in the blade and connected at the hub between said concentric conductor elements.

4. Apparatus as claimed in claim 1 wherein said induction means comprises a fixed stator winding to generate said varying magnetic flux in the rotor core.

5. Apparatus as claimed in claim 4 wherein said induction means includes a fixed stator core arranged to complete a magnetic circuit with the rotor core with air gaps between the stator and rotor cores.

6. Apparatus as claimed in claim 1 wherein said induction means comprises the stator core and winding of an induction motor and the rotor core and rotor winding constitute the rotor of the motor, whereby said motor is operative simultaneously to rotate the shaft and to induce said heating current.

7. Apparatus as claimed in claim 1 wherein said induction means comprises the stator of an electric generator arranged to generate a current in the rotor winding on rotation of the shaft.

* * * * *